US005159982A

United States Patent [19]

Hynes

[11] Patent Number: 5,159,982

[45] Date of Patent: Nov. 3, 1992

[54] DOUBLE WALLED RISER

[75] Inventor: Joseph H. Hynes, Houston, Tex.

[73] Assignee: Cooper Industries, Inc., Houston, Tex.

[21] Appl. No.: 736,087

[22] Filed: Jul. 26, 1991

[51] Int. Cl.[5] ..... E21B 7/00

[52] U.S. Cl. ..... 166/345; 166/378

[58] Field of Search ..... 166/336, 338, 344, 345, 166/348, 366-368, 369, 378, 380

[56] References Cited

U.S. PATENT DOCUMENTS 3,500,906 3/1970 Peterson ..... 166/345 X
4,478,287 10/1984 Hynes et al. ..... 166/345 X
4,887,671 12/1989 Hynes ..... 166/344

*Primary Examiner*—Thuy M. Bui
*Attorney, Agent, or Firm*—William E. Shull; David A. Rose; Ned L. Conley

[57] ABSTRACT

A double walled riser extends from a platform to a subsea well and is connected, through a suitable connector, to the top of the wellhead housing. The wellhead housing has annulus access passageways therein. The connector has passageways therethrough which communicate at one end with the annulus access passageways in the wellhead housing and at the other end with small diameter annulus access tubes carried between the two walls of the double walled riser. The inner wall of the double walled riser comprises a pressure containing member, and the outer wall comprises a structural support member. The small diameter annulus access tubes disposed in the annulus between the inner and outer walls of the riser communicate at one end with one of the respective passageways through the connector, and extend at the other end to the platform. The riser comprises a plurality of joints having a male connecting end and a female connecting end, and adapted to be connected together end to end in locked, sealed relation to form a single riser string from the wellhead to the platform. The small diameter annulus access tubes disposed in the annulus of each riser joint have at one end a male stab nipple carrying a seal ring, and at their other end of female sealing receptacle. When the riser joints are made up on the rig, the small diameter tubes are stabbed together in sealed relation to form continuous, pressure-conveying tubes communicating selected wellhead annuli to the platform.

20 Claims, 6 Drawing Sheets

DOUBLE WALLED RISER

BACKGROUND OF THE INVENTION

The present invention relates to the field of oil and gas production methods and apparatus, and more particularly to the field of tubular conduits used in the production of oil and gas from offshore locations. More particularly still, the present invention relates to the field of high pressure risers for tying an existing well at the bottom of a body of water back to a platform at the surface.

In the production of oil and gas from offshore locations, it is often advantageous to employ a platform or similar structure at the surface of the body of water above the field to be developed in order to centralize the drilling and/or production operations for a plurality of wells in the vicinity of the platform. When an offshore field development program includes the use of such a platform, frequently the most economical approach is to predrill all or a substantial portion of the wells prior to installation of the platform, due primarily to the long lead time required for manufacturing and installing an offshore platform. Typically, the wells that are predrilled are left at the mudline ready for completion and in a condition which allows the operators to tie them back to the platform when the time comes. This means that the several concentric strings of progressively smaller diameter, but longer, casing comprised in the particular casing program are already run, hung off in the wellhead, and cemented in place, and the wellhead may be capped at its upper end with, for example, a temporary abandonment cap. As an example, such a temporarily abandoned well may have a 30" conductor pipe, a 20"" surface casing, and intermediate casing strings of 13⅜" and 9⅝ (or 10¾") OD already installed. When the platform is installed and ready for service, the predrilled wells are tied back to the platform and completed, and the remaining wells in the program, if any, may be drilled from the platform using, for example, conventional land-type equipment and techniques.

According to conventional practice, the predrilled wells are typically tied back to the surface platform from the wellhead at the sea floor by running and setting a plurality of concentric risers from the platform to selected casing strings, and the outermost riser is generally tied back to the wellhead for structural integrity. The risers provide access from the platform to the corresponding annuli between the respective casing strings in order to monitor annulus pressures and to facilitate the production, workover, or other operations conducted from the platform. Each of the risers of the plurality of concentric risers is typically run, stabbed in, and sealed at the wellhead separately, thus requiring a plurality of sometimes difficult, usually time-consuming, and sometimes ineffective remote stab-in and seal energizing procedures. With the high hourly costs associated with operating from an offshore platform, the cost of individually running and setting the plurality of concentric risers can be great.

Recently, a breakthrough in the design of offshore wellhead equipment has occurred which permits the respective annuli in the wellhead to be accessed through longitudinally extending fluid passageways disposed in the walls of the wellhead housing which communicate at one end with the respective annuli and at the other end with a space above the upper surface of the wellhead housing. See U.S. Pat. No. 4,887,672, issued Dec. 19, 1989, to the present Applicant and owned by the assignee of the present application (hereinafter referred to as "the '672 patent"), the disclosure of which is incorporated herein by reference. The '672 patent did not address, however, an adequate solution to the problems referred to above in connection with the traditional high cost of running, stabbing in, and sealing a plurality of concentric risers from the platform to the wellhead. Nevertheless, the breakthrough embodied in the '672 patent has set the stage for the present invention, which permits the simple, effective, efficient, and economical communication of the respective annulus access passageways or bores in a wellhead housing of that type to the surface while eliminating the need for the plurality of concentric risers of the prior art with their attendant high installation costs.

SUMMARY OF THE INVENTION

The present invention comprises a double walled riser adapted to be connected at one end to the top of a wellhead of the type disclosed in the '672 patent through a suitable connector, and extended at the other end to the platform at the surface. The connector has passageways or bores therethrough which communicate at one end with the annulus access passageways or bores in the wall of the wellhead housing and at the other end with an annulus access tube extending between the two walls of the double walled riser. The double walled riser has an inner wall which comprises a pressure containing member, and an outer wall which comprises a structural support member giving the riser sufficient strength to withstand expected side or bending loads encountered in service. The OD of the inner wall is less than the ID of the outer wall, forming the annulus between the walls. A plurality, in most cases, of small diameter annulus access tubes are disposed in the annulus between the inner and outer walls of the riser and communicate at one end with one of the respective passageways through the connector, and extend at the other end to the platform.

The double walled riser of the present invention comprises a plurality of joints or riser sections having a male connecting end and a female connecting end, and adapted to be connected together end to end to form a single riser string from the wellhead to the platform. Each of the joints or riser sections has a tapered groove disposed around its outer surface at its male connecting end, and a plurality of circumferentially disposed, radially actuable locking dogs disposed through the wall of its female connecting end. The male end of one joint is received in the female end of an adjacent joint, and the locking dogs are actuated into the groove to lock the joints together. At the same time, actuation of the locking dogs into the tapered groove energizes a gasket disposed between the ends of the joints to seal the connection between them. The connector disposed between the wellhead housing and the lowermost riser joint has an upper, male connecting portion to connect, lock, and seal with the female end of that lowermost riser joint. A gasket is similarly disposed between the upper end of the connector and the lower end of the lowermost riser joint.

The small diameter annulus access tubes disposed in the annulus of each riser joint have at one end a male stab nipple carrying a seal ring, and at the other end a female sealing receptacle. The male stab nipple of the small diameter annulus access tubes is advantageously employed at the end of the riser joint having the female riser joint connecting portion, and the female sealing receptacle for the small diameter annulus access tubes is then disposed at the end of the riser joint having the male riser joint connecting portion. The male connecting ends of the riser joints have longitudinally extending bores with an annular shoulder around their inner ends against which the female ends of the small diameter access tubes abut when the access tubes are inserted into the bores and then into the annulus between the inner and outer walls of the riser joints. The female connecting ends of the riser joints have longitudinally extending bores in register with the bores in the male connecting ends through which extend the male stab nipples of the small diameter access tubes when fully installed in the riser joints. A threaded ring disposed on the OD of each of the small diameter access tubes above the male stab nipple opposes a shoulder around the longitudinally extending bores in the female connecting ends of the riser joints and prevents the tubes from being removed axially from the riser joints, while permitting limited axial and radial movement of the small diameter access tubes within the riser joints. When the riser joints are made up, the male stab nipples of the small diameter annulus access tubes of one riser joint mate with and seal against the female receptacles of the small diameter annulus access tubes of the adjacent riser joint, forming a telescoping or sliding metal-to-metal or elastomer, or both, seal between the ends of the small diameter annulus access tubes.

The riser joints are made up and run one at a time from the platform, somewhat like a drilling riser, so the small diameter annulus access tubes may be properly aligned with one another to permit the stabbing and sealing of the adjacent male and female annulus access tube ends. When so connected together through all the riser joints, the small diameter annulus access tubes communicate each of the respective selected annuli of the of the wellhead to the surface, within the protective confines of the double walled riser string. Only one remote connection need be made, that is, the connection between the connector disposed on the lower end of the lowermost riser joint and the wellhead housing. This is in contrast to the typical prior art techniques which require multiple remote stabbing in and sealing procedures for the concentric riser strings, as discussed above.

The wellhead housing which is adapted for receiving the connector and the attached double walled riser of the present invention must be oriented properly with respect to the guide base installed around the well site. The connector and the attached double walled riser are then run and oriented with respect to the wellhead housing, the connector being provided with outboard guide arms and funnels within which the guide posts on the guide base are received when the connector is lowered to the well. The top of the wellhead housing is also provided with a plurality of dowel pin bores for receiving dowel pins extending from the bottom of the connector for further, finally aligning the connector with respect to the wellhead housing when the sole remote connection of the present riser is made up, thus assuring proper alignment of the passages in the connector with the annulus access passages in the walls of the wellhead housing.

Thus, it can be seen that the double walled riser of the present invention can be quickly and easily run from the platform to the wellhead, establishing access at the platform to all desired annuli in the well, without incurring the high costs of individually running and setting a plurality of concentric risers.

In order to manufacture the riser joints of the present invention, the outer wall of the joint is initially shorter than the inner wall, and is pushed out of the way while one of the connectors, either the male or the female connector, is welded first to the inner wall. This pressure containing weld can thus be properly made and X-rayed before the first connector is welded to the outer wall, which is pushed back into position to accomplish this next weld. Since the outer wall is shorter than the inner wall, the connector at the other end of the riser joint can then be welded to the inner wall and X-rayed, this weld also being a pressure containing weld, free from interference by the outer wall. Finally, a short, 180-degree split piece of outer wall is placed into position between the free end of the shorter outer wall and the adjacent connector, and the remaining two welds are made, one between the free end of the outer wall and the adjacent end of the short, split wall section and the other between the other end of the short, split wall section and the adjacent connector, to complete the outer wall and, thus, the riser joint.

These and other objects and advantages of the invention will become apparent from the following description of the preferred embodiment when read in conjunction with reference to the following drawings, wherein:

DESCRIPTION OF THE PREFERRED EMBODIMENT

Figure 1:
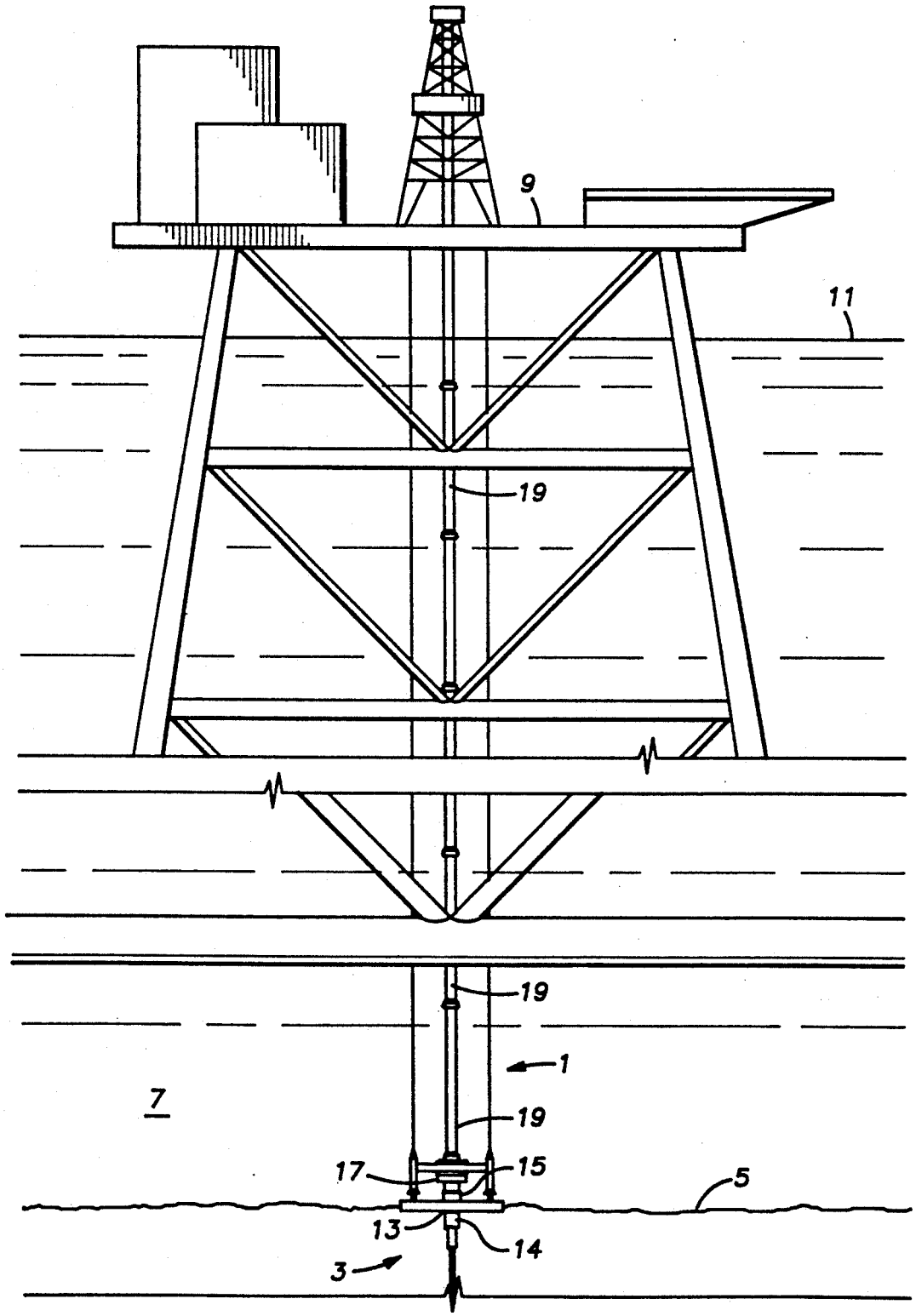
FIG. 1 is a schematic representation of a typical environment in which the double walled riser of the present invention will be found useful.

Referring to FIG. 1, there is shown a schematic representation of the general environment in which the double walled riser of the present invention, indicated generally at 1, will be found useful. A subsea oil and/or gas well 3 is disposed at the bottom 5 of a body of water 7, and a platform 9 is disposed at or above the surface 11 of the body water, generally above the subsea well 3. Platform 9 may be, for example, a bottom supported platform and thus disposed above the surface 11 of the body of water, or it may be, for example, a tension leg platform and thus disposed at the surface 11. The well 3 includes a wellhead 13 disposed at the top of the well substantially at or near the mudline, and a plurality of successively smaller diameter, but longer, concentric casing strings 14 extend from the wellhead down into the earth. The wellhead 13 includes a tubular wellhead housing 15 typically protruding upwardly from the sea floor. The casing strings 14 are typically suspended from and sealed with respect to the wellhead housing 15, and cemented in place. The wellhead housing 15 typically will protrude from the sea floor sufficiently to facilitate access thereto after the well has been temporarily abandoned and it is then desired to tie the well back to the platform with the double walled riser 1 of the present invention.

The double walled riser 1 of the present invention is connected to the top of the wellhead housing 15 through a suitable connector 17. The riser 1 comprises a plurality of joints 19 of double walled riser pipe connected together end to end to form a string extending from the connector 17 to the platform 9. The wellhead housing 15 is of a type as disclosed in the '672 patent, having a plurality of annulus access passageways or bores extending longitudinally through the wall of the housing from the respective annuli between selected casings 14 in the wellhead to the top of the housing, where they communicate with passages extending through the connector 17 and to a small diameter annulus access tube carried in an annulus between inner and outer walls of the double walled riser 1, as described further below. The annulus access passageways through the wellhead housing 15 and the connector 17 are thus communicated to the platform through the small diameter annulus access tubes disposed in the annulus between the inner and outer walls of the riser 1.

Figure 2:
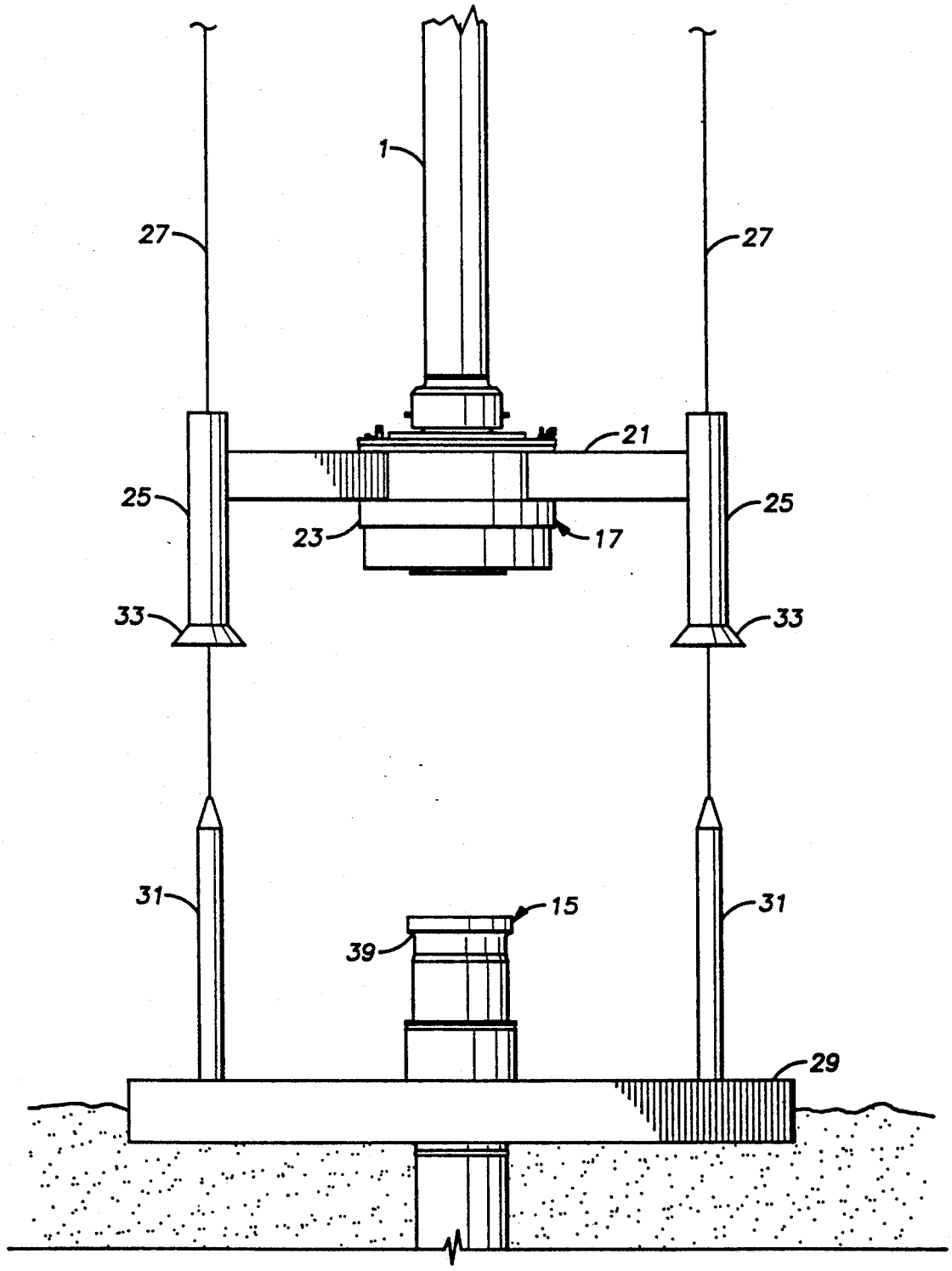
FIG. 2 is an elevational view showing the double walled riser of the present invention being lowered into place over an existing subsea wellhead.

Referring now to FIG. 2, there is shown an elevational view of a riser 1 of the present invention attached to a connector 17 and being lowered to the well above the wellhead housing 15 in preparation for landing the connector 17 on top of the wellhead housing 15 and locking it in place thereon. The wellhead will have been cleaned of mud or debris, if necessary, and any abandonment cap or the like removed prior to lowering the connector 17 and riser 1 to the well. The connector 17 has a plurality of guide arms 21 attached to its exterior surface and extending radially outwardly from the generally cylindrical connector body 23. Guide arms 21 each have a tubular guide sleeve 25 disposed at their outer ends in a generally vertical orientation for receiving one of a plurality of guide wires 27 extending to the platform 9. The guide wires 27 disposed within the guide sleeves 25 facilitate lowering the connector 17, with the attached riser 1, to the well in a proper orientation.

A guide base 29 is disposed around the wellhead on the sea floor and includes a plurality of upwardly extending guide posts 31 over which the guide sleeves 25 are received when the connector 17 is lowered onto the wellhead 15. The guide sleeves 25 each have a downwardly facing funnel 33 at their lower ends for facilitating the lowering of the sleeves 25 onto the guide posts 31.

Figure 3:
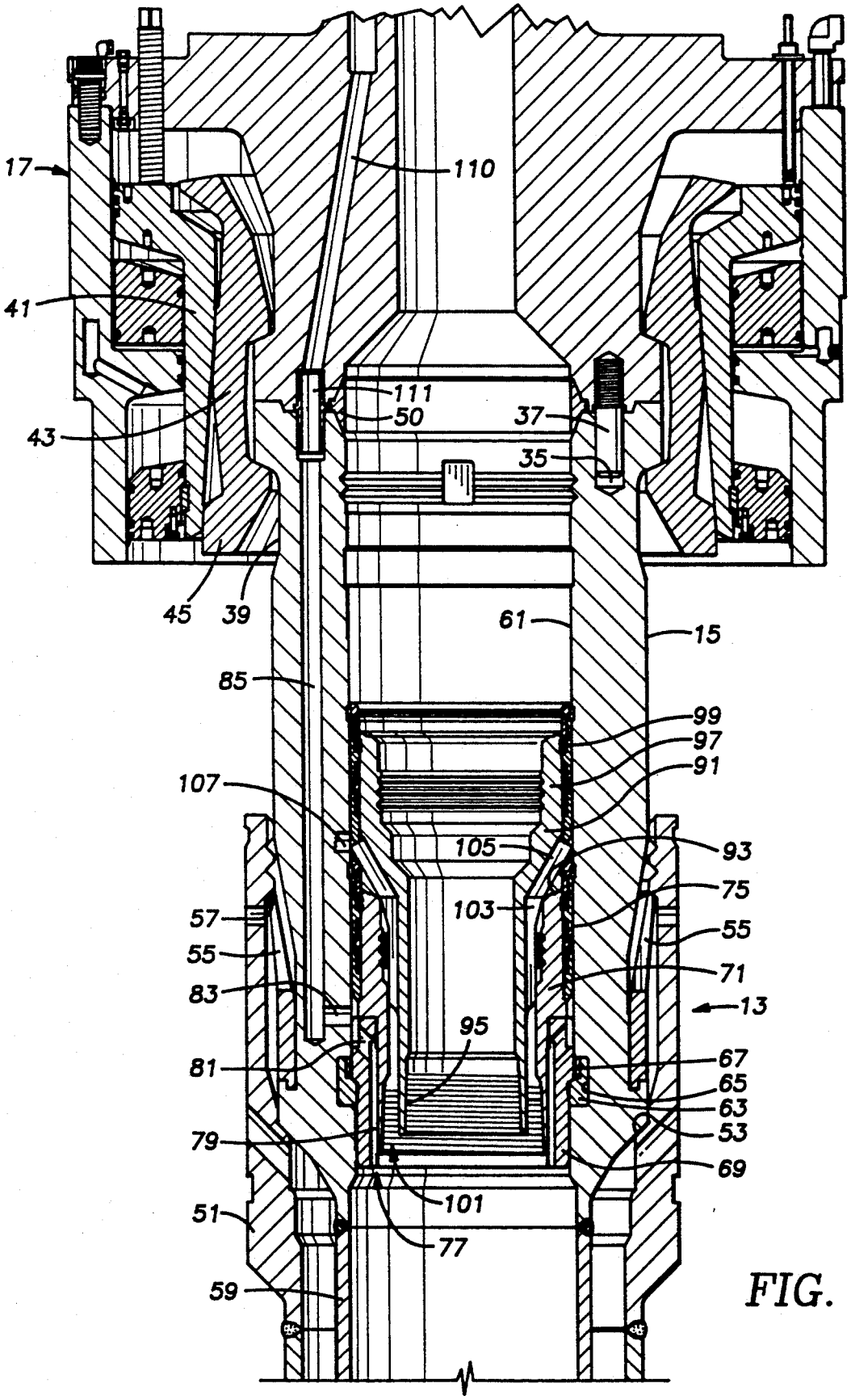
FIG. 3 is a vertical sectional view of a wellhead of a type with which the double walled riser of the present invention will be found useful, and a connector for connecting the riser to the wellhead housing.
Figure 7:
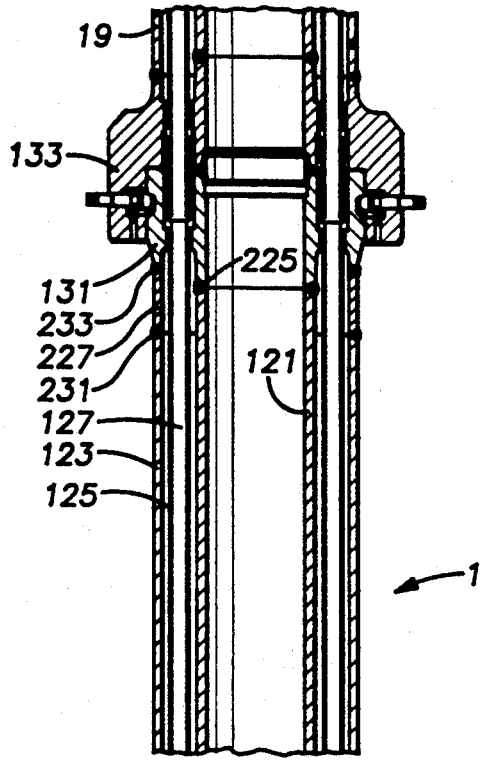
FIG. 7 is a plan view of the top of the wellhead housing shown in FIG. 2.
Figure 7:
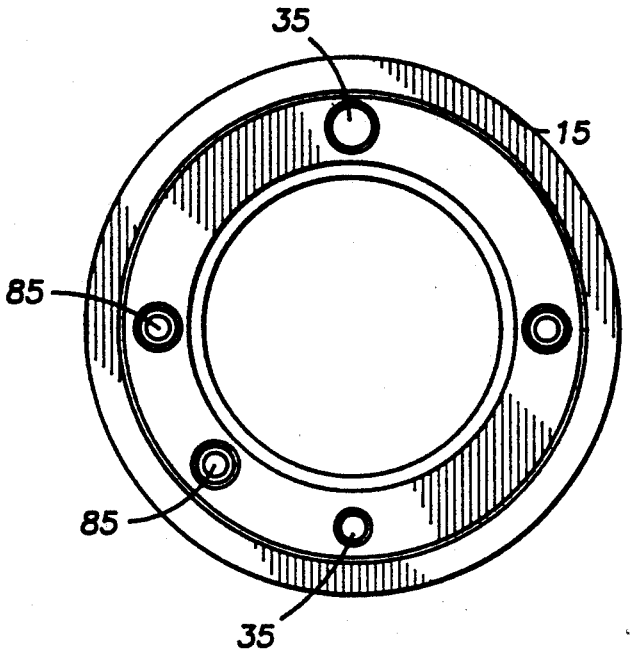

The upper terminal end of the wellhead housing 15 has a plurality of longitudinally extending, blind dowel pin bores therein, as shown at 35 in FIG. 7, for receiving a plurality of correlatively shaped, downwardly extending dowel pins 37, shown in FIG. 3, disposed on the lower end of the connector 17 for final angular orientation of the connector with respect to the wellhead housing and permitting the connector to be lowered into place on top of the housing. One of the dowel pins 37 may be, for example, larger in diameter than another, with the dowel pin bores 35 in the top of the wellhead housing being sized accordingly, to preclude the connector from being lowered onto the wellhead housing in an improper orientation. The dowel pin bores 35 have a beveled or tapered surface around their upper inner peripheries to facilitate landing the dowel pins in the bores. The initial installation of the wellhead housing 15 is carried out to ensure the desired orientation of the wellhead housing with respect to the guide base so that the subsequent lowering of the riser 1 and connector 17 to the wellhead housing 15 may be effected with the correlative proper orientation of the connector 17 and riser 1 with respect to the wellhead housing.

The connector 17 may be any of a variety of known connectors, modified as described herein to accommodate the annulus access passageways in the wellhead housing and communicate them to the small diameter annulus access tubes disposed in the annulus of the double walled riser 1. A collet connector of the type disclosed, for example, in Cameron Iron Works U.S.A. Inc. 1990–1991 General Catalog, page 752, may be found suitable for connector 17. Connector 17 is adapted for lockingly engaging the upper, outer hub profile 39 of the wellhead housing 15 and actuating a gasket seal or the like disposed around the bores of the connector and the wellhead housing between the top of the wellhead housing and the lower face of the connector to seal the connection between the bores.

Referring now to FIG. 3, there is shown an enlarged, vertical cross sectional view of the wellhead 13 and wellhead housing 15 of a type useful with the present invention, with a collet connector 17 attached to the upper hub end 39 of the wellhead housing 15. Dowel pins 37 mounted on the lower face of the collet connector are received in alignment bores 35 disposed in the upper terminal end of the wellhead housing 15. A slidable sleeve 41 is engageable with the radially outer surfaces of a plurality of radially actuable collet fingers 43 disposed around the ID of the connector 17 at its lower end in order to actuate the locking ends 45 of the collet fingers 43 into engagement with the hub 39 to lock the collet connector to the wellhead housing. The sleeve 41 may be moved to retract from the outer surfaces of the collet fingers in order to release the collet connector 17 from the hub 39 of the wellhead housing 15. A gasket 50 is disposed around the central axial bores of the connector 17 and the wellhead housing 15 between the two abutting ends of the members, and is actuated into tight sealing engagement between such members when the collet connector is locked to the top of the wellhead housing.

The wellhead housing 15 is landed and supported in a conductor housing 51, which may be, for example, a housing for 30" conductor pipe, which is typically driven, drilled, or jetted into the sea floor. The wellhead housing 15 is supported on an annular shoulder 53 disposed around the ID of conductor housing 51, and locked down through engagement of the upper terminal ends of a plurality of radially actuable locking fingers 55 with the underside of an annular shoulder 57 disposed around the ID of the conductor housing 51 near its upper end. The locking fingers 55 cam inwardly when they pass by the shoulder 57 as the wellhead housing 15 is lowered into place, and snap outwardly into locking position when the wellhead housing is seated on the support shoulder 53. The locking fingers 55 tend to push downwardly, with a predetermined load, on the wellhead housing against shoulder 53 on the conductor housing when they snap into place below shoulder 57, thereby imparting a desired, predetermined amount of preload for the wellhead housing as supported on the load shoulder of the conductor housing. A string of surface casing 59, which may be, for example, 20" OD casing, is supported from the lower end of the wellhead housing 15. In the example illustrated, i.e., with a 20" surface casing, the internal bore 61 of the wellhead housing above the surface casing may be, for example, about 18¾" inches in diameter.

Near the lower end of the wellhead housing 15, in a groove 65 around the ID thereof, there is disposed a high strength load shoulder 63, held in groove 65 by a retainer ring 67. The high strength load shoulder 63 is preferably made of material having a yield strength of the order of 160,000 psi, and preferably will support a load of the order of 7 million pounds. The load shoulder 63 supports a hanger 69 adapted for suspending the next smaller sized casing string, which may be, for example, a string of 13⅜" casing. The upper part 71 of the hanger 69 includes a smooth sealing surface around its OD, which is spaced radially inwardly from a corresponding sealing surface around the ID of the wellhead housing. A seal assembly 75 is disposed in the annular space between the upper part 71 of the hanger 69 and the wellhead housing wall, thereby sealing from above the annular space 77 between the 20" casing and the 13⅜" casing. A plurality of slots 79 and ports 81 in the hanger 69 communicate the 20"×13⅜" annulus 77 via a radially extending passage or bore 83 in the wellhead housing to a longitudinally extending annulus access passageway or bore 85 disposed in the wall of the wellhead housing 15. The bore 85 thus communicates with the annulus 77 via the bore 83, the ports 81 and the slots 79, and extends to the top of the wellhead housing 15.

A hanger 91 is supported atop the upper terminal end 93 of the hanger 69 for supporting the next smaller sized string of casing 95, which may be, for example, a string of 9⅝" or 10¾" casing. The upper part 97 of the hanger 91 includes a smooth sealing surface around its OD, which is spaced radially inwardly from a corresponding sealing surface around the ID of the wellhead housing. A seal assembly 99 is disposed in the annular space between the upper part 97 of the hanger 91 and the wellhead housing wall, thereby sealing from above the annular space 101 between the 13⅜" casing and the 9⅝" casing. A plurality of slots 103 and ports 105 in the hanger 91 communicate the 13⅜"×9⅝" annulus 101 via a radially extending passage or bore 107 in the wellhead housing to a second longitudinally extending annulus access passageway or bore, not shown, disposed in the wall of the wellhead housing 15, spaced circumferentially from the passageway 85. The second annulus access bore, not shown, thus communicates with the annulus 101 via the bore 107, the ports 105 and the slots 103, and extends to the upper terminal end of the wellhead housing 15 like the passageway 85.

The connector 17 has a plurality of fluid carrying passages 110 therein, extending from and through the lower terminal end of the connector to and through the upper terminal end of the connector. There is a passageway 110 in connector 17 at least for each of the longitudinally extending annulus access passageways in the wellhead housing, and such passageways in the connector and the wellhead housing are aligned or put in register with one another when the connector is remotely aligned and attached to the wellhead housing as described above. Each of the passageways 110 of the connector 17 has disposed therein at its lower terminus a stab seal nipple 111 carrying on each of its ends a seal ring, such as a metal gasket for forming a metal-to-metal seal, an elastomer seal ring, or a combination of the two types of seals. When the connector 17 is lowered to the well, the stab seal nipples 111 are disposed in passageways 110 such that their upper ends are received in and seal against the bores of the passageways 110, and their lower or free ends extend downwardly from the lower end of the connector 17. When the connector 17 is made up to the wellhead housing, the downwardly extending free ends of the stab seal nipples 111 stab into and seal against the walls of the longitudinally extending annulus access bores of the wellhead housing, thus establishing fluid tight passageways from the annuli below the seal assemblies in the wellhead to the upper terminal end of the connector.

Figure 5:
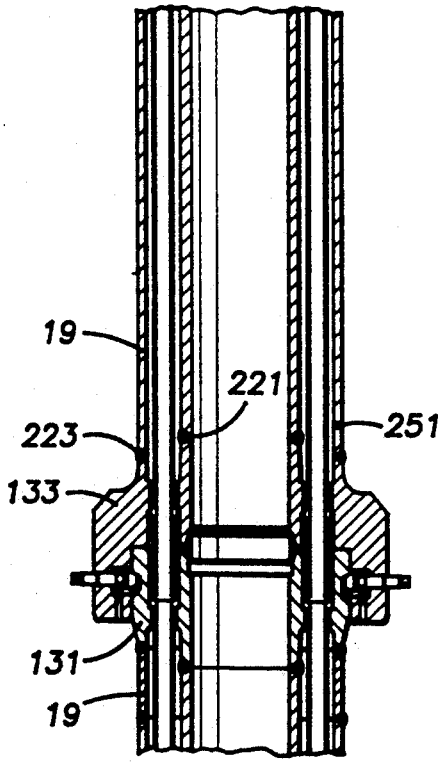
FIG. 5 is a fragmentary view of a joint of double walled riser pipe of the present invention, with adjacent joints attached at each end.
Figure 6:
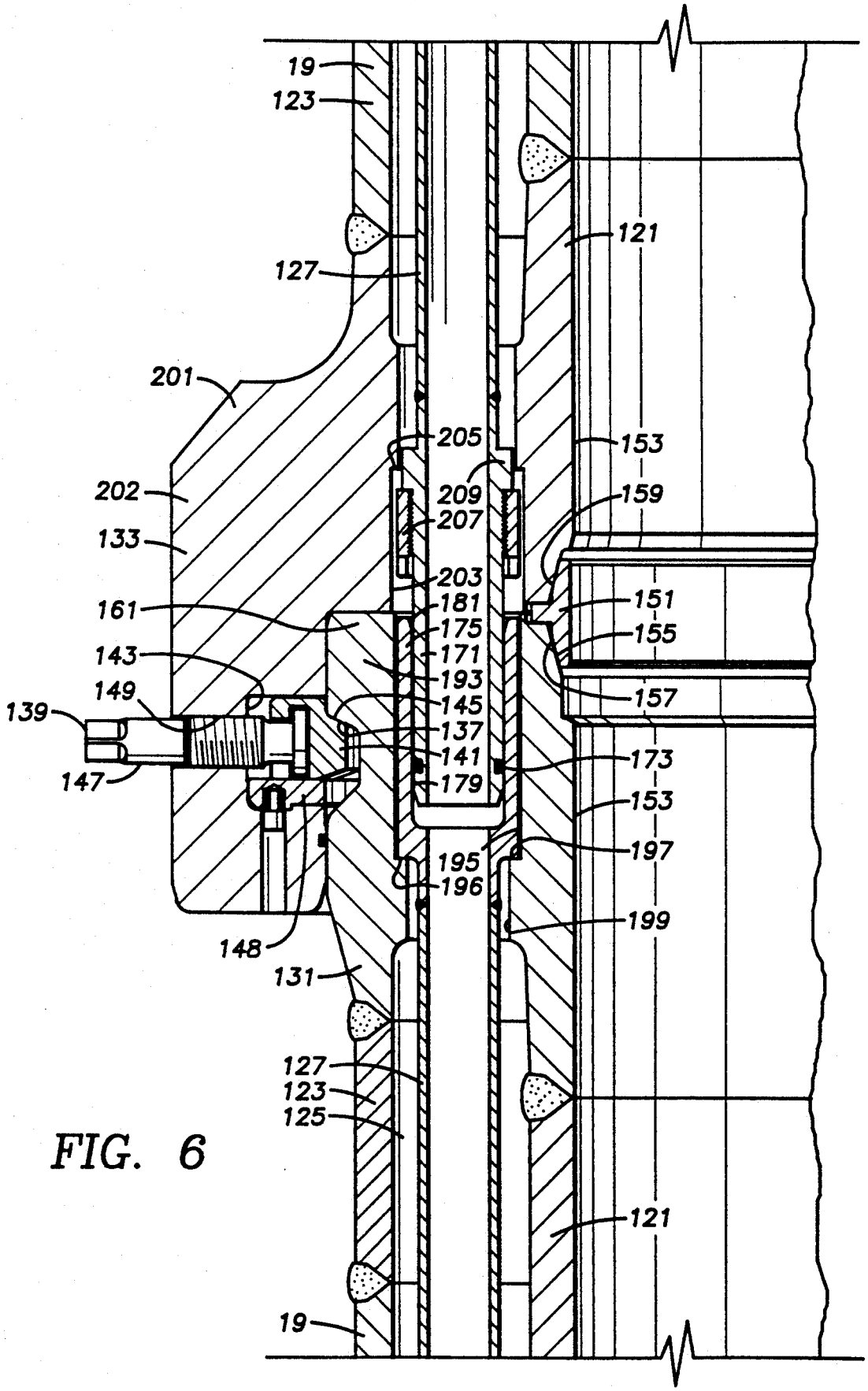
FIG. 6 is an enlarged view of the connection between double walled riser pipe joints of the present invention.

Referring now to FIGS. 5 and 6, the elements of the double walled riser of the present invention are shown in detail. The double walled riser 1 has an inner tubular wall 121 which comprises a pressure containing member, and an outer tubular wall 123 which comprises a structural support member giving the riser 1 sufficient strength to withstand expected side or bending loads encountered in service. Accordingly, the materials and dimensions, particularly the radial thickness, of the walls 121, 123 are selected in order to withstand such expected pressures and loads. The OD of the inner wall 121 is less than the ID of the outer wall 123, thereby forming an annulus 125 between the walls. A plurality, in most cases, of small diameter annulus access tubes 127 are disposed in the annulus 125 between the inner and outer walls 121, 123 of the riser 1 and communicate at one end with one of the respective passageways 110 through the connector 17, and extend at the other end to the platform 9.

The double walled riser 1 of the present invention comprises a plurality of joints or riser sections 19 having a male connecting end 131 and a female connecting end 133, and adapted to be connected together end to end, the male end of one joint being connected to the female end of the adjacent joint, to form a single riser string from the wellhead 13 to the platform 9. At the platform, the riser may be terminated in a land-type wellhead, for example, having a female connecting portion like that in the riser joints. The riser joints may be, for example, about 50 feet in length. In order to adapt the riser string to fit substantially any desired platform height above the well, the last joint of riser pipe can be custom made to the appropriate length. Each of the joints or riser sections 19 has a tapered groove 137 disposed around its outer surface at its male connecting end 131, and a plurality of circumferentially spaced apart, radially actuable locking members 139 disposed through the wall of its female connecting end 133. The male end 131 of one joint 19 is received in the female end 133 of an adjacent joint 19, and the locking members 139 are actuated to lock the adjacent joints together.

The locking members 139 include actuating dog segments 141 disposed around the radially inner portion of an annular groove 143 around the ID of the female connecting end 133. The dog segments 141 have an upwardly and inwardly facing, downwardly and inwardly tapering, frustoconical shaped camming surface 145 on their upper inner peripheries. Each of the locking members 139 has an actuating stem 147 attached to the radially outer side of its dog segment 141 and threadedly disposed in a radially extending threaded bore 149 for actuating the dogs radially inwardly and outwardly when the stem 147 is screwed into or out of, respectively, its bore 149. A wear insert 148 is disposed at the bottom of groove 143, on which the dog segments 141 slide for facilitating actuation of the dogs and reducing wear. Camming surfaces 145 are engageable with the downwardly and outwardly facing, downwardly and inwardly tapering groove 137 around the OD of the male connecting portion 131 when male end 131 is inserted sufficiently into female end 133 and the dog segments are actuated inwardly. The camming action of the engaging surfaces 137, 145 of the circumferentially spaced apart locking members 139 and the groove 137 draws the male end 131 of one joint into tight engagement with the female end 133 of the adjacent joint, thereby locking the two joints together. At the same time, actuation of the locking dogs 141 into the tapered groove 137 energizes a gasket 151 disposed around the central axial bores 153 of the riser joints 19 in a groove 155 between the ends of the adjacent joints to seal the connection between them. Grooves 155 are formed by an upwardly and inwardly facing, downwardly and inwardly tapering surface 157 around the upper inner periphery of the ID of male connecting end 131, and a downwardly and inwardly facing, upwardly and inwardly tapering surface 159 around the lower inner periphery of the ID of female connecting end 133.

Figure 4:
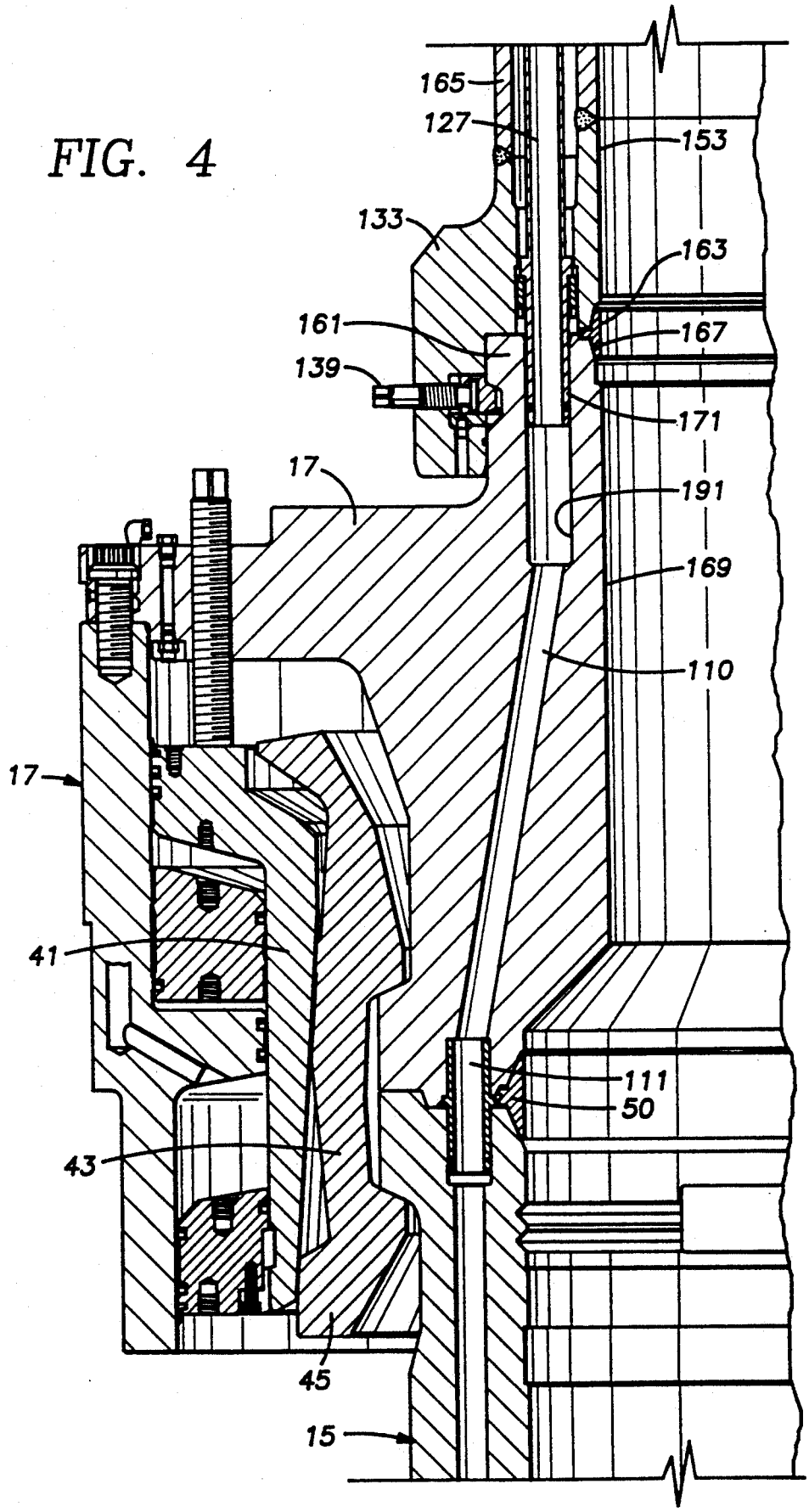
FIG. 4 is a vertical sectional view of the connector shown in FIG. 3, with the lowermost joint of double walled riser pipe of the present invention attached thereto.

As shown in FIG. 4, connector 17 has an upper male connecting portion 161 shaped correlatively to male connecting portions 131 of riser joints 19 to connect, lock, and seal with the female end 133 of the lowermost riser joint 19, shown also as joint 165 in FIG. 4, in like manner as described above with regard to the connection between two adjacent riser joints 19. A gasket 163 is disposed around the central axial bore 153 of riser joint 165 and the central axial bore 169 of connector 17 in a groove 167 between the upper end of connecting portion 161 and the lower end of riser joint 165, in order to seal the connection between them. Groove 167 is formed by adjacent tapering surfaces on the connector 17 and the joint 165 like surfaces 157, 159 described above for the sealed connection between riser joints.

Referring again to FIGS. 5 and 6, the small diameter annulus access tubes 127 disposed in the annulus 125 of each riser joint 19 have at one end a male stab nipple 171 carrying a seal ring 173 in an annular groove around its outer periphery near its lower end, and at their other end a female sealing receptacle 175. The male stab nipple 171 of tubes 127 is disposed, for example, at the end of the riser joint 19 having the female connecting portion 133, and the female sealing receptacle 175 of tubes 127 is disposed at the other end of the riser joint 19 having the male connecting portion 131. The terminal end of each stab nipple 171 has a taper 179 around its outer periphery, and the terminal end of each sealing receptacle 175 has a taper 181 around its inner periphery, to facilitate the stabbing of the nipple 171 into the receptacle 175. The seal ring 173 effects a sliding seal between the nipple 171 and the receptacle 175 when the connection 171, 175 is made up. Seal ring 173 may be, for example, a metal ring for establishing a metal-to-metal seal, an elastomer or resilient seal ring such as an "O" ring, or a combination of the two types of seals. Thus, when the adjoining ends of two riser joints 19 are connected together, the small diameter tube joints 127 are also connected together in sealed relation as the male portions 171 of tube joints 127 protruding from the end 133 of one riser joint 19 stab into and seal against the female portions 175 of tube joints 127, which portions 175 are disposed in and substantially flush with the end 131 of the adjacent riser joint.

As shown in FIG. 4, the upper ends of the passageways 110 in connector 17 each have a female sealing receptacle 191 shaped correlatively to female sealing receptacles 175 of tubes 127 to establish sealed connections with the male stab nipples 171 of the lowermost riser joint 165, in like manner as described above with regard to the connection 171, 175 between two adjacent tube joints 127.

The male connecting portions 131 of the riser joints 19 have substantially solid, generally circular cylindrical terminal end portions 193 with longitudinally extending, small diameter bores 195 therein for slidingly receiving the female sealing receptacles 175 of tubes 127. Each of the bores 195 has an annular shoulder 197 around their axially inner ends against which the lower ends 196 of the female sealing receptacles 175 abut when the access tubes 127 are fully inserted into the bores 195. The tubes 127 extend from bores 195, through narrower neck bores 199 below the bores 195, and into and through the annulus 125 between the inner and outer walls 121, 123 of the riser joints 19.

The female connecting portions 133 of the riser joints 19 comprise substantially solid, generally circular cylindrical upper portions 201 with longitudinally extending, small diameter bores 203 therein for receiving the upper portions of male stab nipples 171 of tubes 127. A lower, annular, circular cylindrical skirt portion 202 of female connecting end 133 extends below the terminal end face of the upper portion 201. Skirt portion 202 telescopes over the male end portion 131 of the adjacent riser joint in order to connect them together as described above. Skirt portion 202 includes the locking members 139 as previously described. A substantially length of each stab nipple 171 protrudes from the terminal end face of upper portion 201 of female connecting end 133. Thus, the seal members 173 of the tubes 127 are readily observable by the operators making up the riser string 1 on the rig, so that any damage to or other defect in the seals 173 can be corrected prior to making up the joint. Each of the bores 203 has an annular shoulder 205 around their axially inner ends opposing threaded retainer rings 207 which are threaded onto each tube 127 above the stab nipple 171. An annular shoulder or flange 209 disposed around each tube 127 provides a stop for the threaded retainer rings 207. Bores 203 in female connecting ends 133 are in register with bores 195 in the male connecting ends 131 so that tubes 127 extend straight through bores 203 when fully installed in the riser joints from ends 131. There is a small space between the upper terminal ends of retainer rings 207 and shoulder 205 to permit limited axial movement of the tubes 127 in the riser joints 19. There is also a small clearance between the OD of the retainer rings 207 and the ID of bores 203, thereby permitting limited movement of the tubes 127 in a radial direction. Thus, the shoulders 196, 197 and 205, 207 prevent tubes 127 from being removed axially from the riser joints 19, while permitting limited axial and radial movement of the small diameter access tubes 127 within the riser joints.

The riser joints 19 are made up and run one at a time from the platform 9, somewhat like a drilling riser, so the small diameter annulus access tubes 127 may be properly aligned with one another to permit the stabbing and sealing of the adjacent male and female annulus access tube ends 171, 175. When so connected together through all the riser joints 19, and when the lowermost ends of the tubes 127 are connected into the connector 17 as shown in FIG. 4, the tubes 127 communicate each of the respective selected annuli, for example, annuli 77, 101, of the wellhead 13 to the surface, within the protective confines 121, 123 of the double walled riser string 1. It will be appreciated that only one remote connection need be made, that is, the connection between the connector 17 and the wellhead housing 15.

In order to manufacture the riser joints 19 of the present invention, the outer wall 123 of the joint is initially shorter than the inner wall 121, and is pushed longitudinally axially out of the way while one of the connectors, either the male 131 or the female 133 connector, is welded first to the inner wall 121. With reference to FIG. 5, this first weld 221, which is a pressure containing weld, can thus be properly made and X-rayed before the first connector, for example female connector 133, is welded to the outer wall as shown at 223. The outer wall member 123 is pushed longitudinally axially back into position to accomplish this next weld 223. Since the outer wall 123 is initially shorter than the inner wall 121, the connector at the other end of the riser joint, for example male connector 131, can then be welded as shown at 225 to the inner wall and X-rayed, this weld also being a pressure containing weld, free from interference by the outer wall. Finally, a short, 180-degree split piece 227 of outer wall is placed into position between the free end of the shorter outer wall and the adjacent connector 131, and the remaining two welds are made, one between the free end of the outer wall and the adjacent end of the short, split wall section as shown at 231 and the other between the other end of the short, split wall section and the adjacent connector as shown at 233, to complete the outer wall 123 and, thus, the riser joint 19. A bleed port 251 may be disposed in the outer wall as shown in FIG. 5.

While preferred and alternative embodiments of the invention have been shown and described, many modifications thereof may be made by those skilled in the art without departing from the spirit of the invention. Therefore, the scope of the invention should be determined in accordance with the following claims.

I claim:

1. Apparatus for establishing fluid communication between annulus access passageways of a subsea wellhead and an offshore platform, the annulus access passageways communicating with selected wellhead annuli, comprising:

a string of double walled riser pipe extending from the offshore platform to the wellhead, said string of double walled riser pipe comprising an inner tubular wall means for containing wellhead pressures and an outer tubular wall means for imparting structural strength and rigidity to said string of pipe, there being an annular space between said inner wall means and said outer wall means;

fluid carrying tubing means disposed in said annular space for each of the annulus access passageways of the wellhead, said tubing means extending from the wellhead to the platform; and wellhead connector means disposed between said string of pipe and the wellhead for connecting said string of pipe to the wellhead and for establishing fluid communication between each of said tubing means and one of such annulus access passageways.

2. Apparatus according to claim 1, wherein said string of double walled riser pipe comprises a plurality of riser pipe joints connected together end to end to form said string.

3. Apparatus according to claim 2, wherein said riser pipe joints each has a male connecting end and a female connecting end, said male ends being telescopingly received in said female ends of the adjacent riser pipe joints, and further including releasable locking means disposed on said female ends for releasably lockingly engaging said male ends received therein.

4. Apparatus according to claim 3, and further including gasket means disposed around the bores of said inner wall means at each such male-to-female connection of adjacent riser pipe joints for effecting a fluid tight seal for said inner wall means at each of said male-to-female connections.

5. Apparatus according to claim 4, wherein said gasket means are energized by said releasable locking means.

6. Apparatus according to claim 2, wherein each of said riser pipe joints comprises a joint of small diameter tubing disposed in said annular space for each of said tubing means, said joints of small diameter tubing being adapted for end to end connection along with said riser pipe joints to form a tubing string extending the entire length of said string of double walled riser pipe.

7. Apparatus according to claim 6, wherein each of said joints of small diameter tubing has a male stab nipple on one end and a female sealing receptacle on the other end, said male stab nipples being telescopingly received in said female sealing receptacles of the adjacent riser pipe joints when each such male-to-female connection of adjacent riser pipe joints is made up.

8. Apparatus according to claim 7, and further including seal means disposed on each of said male stab nipples of said tubing joints for sealingly engaging said female sealing receptacles of said tubing joints when the riser pipe joints are made up.

9. Apparatus according to claim 7, wherein each of said male stab nipples of said tubing joints is disposed at the female connecting end of the riser pipe joints, and each of said female sealing receptacles of said tubing joints is disposed at the male connecting end of the riser pipe joints.

10. Apparatus according to claim 9, wherein said female connecting ends of said riser pipe joints include a female connector having a generally circular cylindrical body portion and a surrounding skirt portion extending longitudinally axially around the circumference of said cylindrical body portion, and said male stab nipples of each of said tubing joints extend longitudinally axially beyond the terminal end face of said cylindrical body portion.

11. Apparatus according to claim 10, wherein said male connecting ends of said riser pipe joints include a male connector having a generally circular cylindrical body portion receivable within said skirt portion of said female connector, said cylindrical body portion of each of said female connectors of said riser pipe joints includes longitudinally extending bore means for receiving said male stab nipples of said tubing joints therewithin, and said cylindrical body portion of each of said male connectors of said pipe joints includes longitudinally extending bore means in register with said longitudinally extending bore means in said female connectors for receiving said female sealing receptacles of said tubing joints therewith.

12. Apparatus according to claim 11, and further including stop means disposed in said longitudinally extending bores in said male and female connectors in which said tubing joints are received, and stop means on said tubing joints engageable with said stop means in said longitudinally extending bore, for permitting limited axial and radial movement of said tubing joints within said joints of riser pipe.

13. Apparatus according to claim 7, wherein said wellhead connector means includes a central axial bore in register with the bore of said tubular inner wall means, a male connecting portion lockingly receivable within said female connecting end of the lowermost riser pipe joint, a fluid passageway through said wellhead connector means for each of said tubing means, and a gasket means disposed around said bore of said wellhead connector means and said bore of said inner wall means of said lowermost riser joint between the abutting ends of said lowermost riser pipe joint and said wellhead connector means, said male stab nipples of said lowermost riser pipe joint being sealingly received in said fluid passageways of said wellhead connector means.

14. A joint of riser pipe adapted for end-to-end connection with like joints of riser pipe for use in the offshore production of oil and gas, comprising:

a tubular inner wall;

a tubular outer wall disposed around and radially spaced apart from said inner wall, thereby forming an annular space between said walls;

a preselected number of small diameter tubes disposed in said annular space, each of said tubes extending at each end beyond said tubular inner and outer walls;

a male connector disposed at one end of said joint and connected to said inner and outer walls, said male connector closing said annular space around said small diameter tubes at one of their ends;

a female connector disposed at the other end of said joint and connected to said inner and outer walls, said female connector closing said annular space around said small diameter tubes at their other ends;

said small diameter tubes being adapted for end-to-end sealed connection with the small diameter tubes of like riser joints.

15. Apparatus according to claim 14, wherein said small diameter tubes each have a male stab nipple on one of their ends and a female sealing receptacle on their other ends, said male stab nipples being receivable within, and carrying seal means for sealing engagement with, the female sealing receptacles of like riser joints.

16. Apparatus according to claim 15, wherein said male stab nipples are disposed on the female connector end of said riser joint, and said female sealing receptacles are disposed on the male connector end of said riser joint.

17. Apparatus according to claim 16, wherein said male stab nipples protrude beyond the adjacent face of said female connector for permitting access to said seal means.

18. Apparatus according to claim 14, and further including gasket seating means disposed on the terminal ends of the male and female connectors adapted for receiving a gasket for sealing the inner tubular wall of said joint against the female and male connectors, respectively, of like adjacent riser joints.

19. A method of constructing a joint of riser pipe adapted for end-to-end connection with like joints of riser pipe for use in the offshore production of oil and gas, comprising the steps of:

telescoping an outer tubular member over and radially spaced apart from an inner tubular member leaving an annular space between the inner and outer tubular members, the outer tubular member being shorter in axial length than the inner tubular member by a predetermined length;

placing one end of said outer tubular member toward one end of said inner tubular member, leaving a length of said inner tubular member, corresponding to said predetermined length, exposed at the other end thereof;

welding one of a pair of male and female connectors to said other end of said inner tubular member, the weld being a pressure containing weld, and X-raying the weld;

moving said outer tubular member toward said other end of said inner tubular member a distance corresponding to said predetermined length and placing the other end of said outer tubular member adjacent said one of said pair of male and female connectors;

welding said one of said pair of male and female connectors to said other end of said outer tubular member;

welding the other of said pair of male and female connectors to said one end of said inner tubular member, the weld being a pressure containing weld, and X-raying the weld;

placing the halves of a split tubular section of a length corresponding to said predetermined length and a diameter substantially the same as that of said outer tubular member around the inner tubular member between said one end of said outer tubular member and said other of said pair of male and female connectors; and welding said halves of said split tubular section in place, to said one end of said outer tubular member and to said other of said pair of male and female connectors.

20. A method according to claim 19, including the additional step of:

inserting a preselected number of small diameter tubes in the annular space between said inner tubular member and said outer tubular member, each of said tubes extending at each end beyond said inner and outer tubular members into said male and female connectors.

* * * * *